United States Patent [19]

Duncan

[11] 4,390,433

[45] Jun. 28, 1983

[54] DEWATERING SYSTEM WITH WATER DECKLE

[75] Inventor: Jeffrey B. Duncan, Argyle, N.Y.

[73] Assignee: Albany International Corp., Menands, N.Y.

[21] Appl. No.: 319,300

[22] Filed: Nov. 9, 1981

[51] Int. Cl.[3] ..... B01A 29/02

[52] U.S. Cl. ..... 210/767; 162/353; 210/400

[58] Field of Search ..... 210/400, 401, 386, 767, 210/770, 791; 162/348, 351, 353

[56] References Cited

U.S. PATENT DOCUMENTS

| | | | |
|---|---|---|---|
| 1,534,948 | 4/1925 | McLaughlin et al. | 162/348 |
| 2,101,109 | 12/1937 | Thompson | 210/400 |
| 2,345,647 | 4/1944 | Witham | 162/351 |
| 3,468,424 | 9/1969 | Laugel | 210/401 |
| 3,607,624 | 9/1971 | Moody | 162/353 |
| 3,839,148 | 10/1974 | Beck | 162/353 |

*Primary Examiner*—John Adee

*Attorney, Agent, or Firm*—Kane, Dalsimer, Kane, Sullivan & Kurcz

[57] ABSTRACT

A deliquefying system including at least one drainage device having a wear surface and being connected to a source of suction open to the wear surface. A wet web of material to be deliquefied is passed over the wear surface so that liquid is removed from the wet web of material by the drainage device. A liquid deckle is at each exposed end of the drainage device in position to prevent air from entering the drainage device through the end zone and thereby restricting the flow of air to passage through the wet web into the drainage device.

18 Claims, 4 Drawing Figures

DEWATERING SYSTEM WITH WATER DECKLE

BACKGROUND OF THE INVENTION

There are a variety of different industries in which deliquefying systems are employed. In many of those industries, a vacuum dewatering system is used to remove liquid, such as water, from a liquid/particle mixture. This has proven to be an effective way to remove a desired percentage of water from many different types of materials. It has been particularly useful in the papermaking industry where water is removed from pulp. Vacuum dewatering tables of many types and kinds have been devised over the years and continuous improvements are still being made.

Conventionally, the wet web of material is positioned on a forming fabric such as a Fourdrinier wire and that combination is passed continuously over a vacuum table which employs many different types of dewatering mechanisms. Suction pipes and vacuum boxes are common structures and they employ appropriate wear surfaces over which the combination of wire and wet material is passed. To enhance the dewatering aspects of the system, many types of blades or foils are used on the wear surfaces to increase the efficiency of the dewatering operation. These structures can be used independently or in combination with a vacuum source.

A difficulty that is often encountered in the common type of arrangement with the wire passing over the arrangement of vacuum dewatering mechanisms involves the sealing of the end zones. This is the area at the transverse edges of the wire and the drainage devices. It is desirable to have the vacuum mechanisms pull air through the material on the wire thus drawing water from the wet web of material. Vacuum is lost when air can leak in the end zones between the wire and the drainage device. This air does not assist in the dewatering procedure and in fact detracts from it since less water is then drawn through the wire and wet web of material. Accordingly, various types of end seals have been developed over the years and they primarily take the form of solid types of end deckles which are structures employed to plug the end zones and avoid the leakage problem. There are many types of solid end deckles that have been provided through the years and which have been adapted according to the types of drainage devices employed and the material being deliquefied. However, the overall concept has been to employ a rigid type of plug to close the end zones and eliminate the leakage of air at that point thus adding to the efficiency and operation of the system. For example, U.S. Pat. No. 3,836,428 shows appropriate solid end deckles to seal end zones of a suction box arrangement commonly used in the papermaking industry.

No attempts have been made to seal the end zones by fluid means. Fluid such as gases and liquids have been used for other purposes such as edge trimming and restricting the flow of a material in the transverse direction. Application of this general concept is readily apparent from U.S. Pat. Nos. 1,746,434; 2,709,398; 3,075,579; 3,361,620; 3,405,031; 3,607,624; and 3,839,148. However all of the art concerns deckle trimming and does not consider the concept of utilizing a liquid deckle as a seal to prevent air leakage in the end zone of machinery in the papermaking industry or any similar equipment used for deliquefication under the influence of vacuum.

It would certainly be advantageous to be able to employ the advantages of fluids in sealing the end zones in lieu of a solid deckle as a further improvement in the development of deliquefying systems in general and, in particular, dewatering systems for the papermaking industry.

SUMMARY OF THE INVENTION

With the above background in mind, it is among the primary objectives of the present invention to provide an improved end deckle for reducing or eliminating leakage of air into the drainage device through the end zone of a suction deliquefying system. In particular, the concept is utilized in industries employing systems such as a vacuum dewatering system in the papermaking industry.

In vacuum systems of that type, a material to be deliquefied or dewatered is passed as a wet web carried continuously on a woven wire fabric over a dewatering table. Suction is applied to the table so that air drawn through the web collects water to be accumulated in the vacuum drainage table for later use or disposal. In this manner, the web is dewatered. A difficulty that exists with equipment of that type is in connection with the transverse end zones between the wire and the drainage surface of the table. Air can leak through in this zone and into the drainage table without passing through the wet web of material. In addition to the fact that this air does not collect water by passing through the web it also causes loss of vacuum in the system. To eliminate this difficulty, a liquid such as water is injected into the space between the wet web of material and the drainage device for the purpose of reducing or eliminating leakage of air into the drainage device through the end zone.

It is contemplated that the water can be introduced a number of different ways to act as an end deckle. In accordance with this objective, there is no need for a solid deckle to seal the end zones. The water can be injected from the downstream end of the device in an upstream direction under high pressure and counter to the flow of the web of material over the drainage table. This constant flow of water acts as a seal for the end zones and eliminates the leakage of air. Alternatively, the water can be introduced from the upstream end of the drainage table as a low pressure injection into the space of the end zone between the wet of material and the drainage device in the direction of travel of the web of material. Another way in which the water deckle can be formed is to inject water through a narrow groove substantially parallel to the direction of travel of the web of material and formed in the upper wear surface of the drainage device. The injection can either be in the direction of flow of the web of material or counter to the direction of flow.

The water or other fluid is introduced on a continuous basis and is supplied to each individual separate element of structure of the drainage table through which vacuum is applied. This principal is directly applicable to papermaking machinery in which a plurality of sequentially arranged foil blades, suction boxes or suction pipes are employed on the upper surface of the drainage table over which the material to be dewatered is passed as it is carried on a Fourdrinier wire. By a manifold arrangement, the source of water can be introduced to all of the drainage elements on the drainage table to provide appropriate end seals and eliminate the leakage of air into the drainage table through the end zones.

It is an objective of the present invention to provide a deckle formed by a liquid seal for the end zones of the suction drainage equipment without requiring solid elements. This results in a lower cost, elimination of the need for adjustment of solid component parts and good tolerance to normal operating variations.

The concept is particularly applicable to the papermaking industry where Fourdrinier wires are employed and drainage devices including foil blades, suction boxes and suction pipes cooperating with a vacuum source are utilized to dewater a wet web of material.

In summary, a liquid deckle for a deliquefying system is provided. The deliquefying system is the type including at least one drainage device having a wear surface and connected to a source of suction open to the wear surface. It also includes a means for passing a wet web of material to be deliquefied over the wear surface so that the liquid is removed from the web of material by the drainage device. The liquid deckle is positioned at each exposed end of the drainage device in position to prevent air from entering the drainage device through the end zone thereby restricting the flow of air to passage through the wet web into the drainage device.

With the above objectives among others in mind, reference is made to the attached drawings.

DETAILED DESCRIPTION

Figure 1:
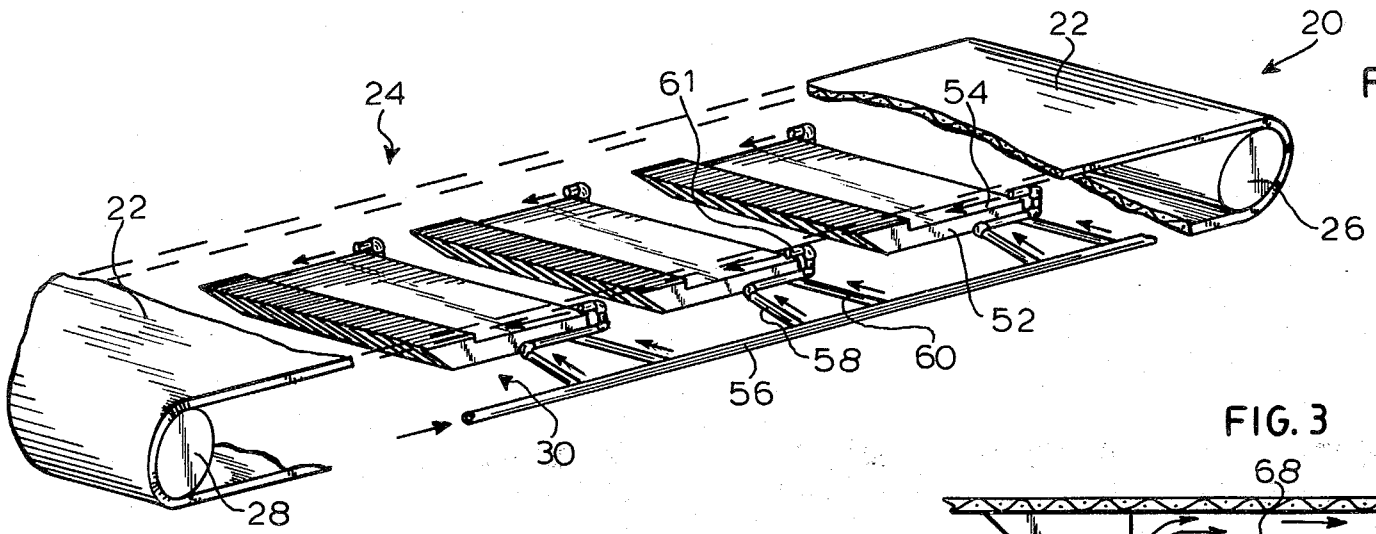
FIG. 1 is a fragmentary perspective view of the liquid deckle of the invention incorporated in a deliquidfying system with arrows showing the direction of flow of the liquid deckle.

The water deckle of the present invention is shown incorporated in use in sealing the end zones of a drainage system employed in the papermaking industry to dewater a web of material. Naturally, the water deckle is designed for use in all known types of vacuum assisted blade type dewatering systems. The water deckle is easily adaptable for use in other similar industries where dewatering or otherwise deliquefying material by the use of suction is employed.

In the depicted form, the conventional papermaking vacuum drainage system 20 includes an elongated Fourdrinier wire 22 which is commonly an endless length of forming fabric that is continuously passed over a drainage table 24 located below. Deposited on the wire 22 is the material to be dewatered which is a wet mass of material to be subjected to the vacuum. The drainage table 24 is connected to a conventional source of suction and employs appropriate means to remove the dewatered material from the wire and to clean the wire 22 between the time it leaves the horizontal upper work surface of the table by passing over downstream end roll 26 until it again enters the horizontal work surface portion of the table by passing over upstream entrance roll 28. Suitable drive means and controls are also employed to direct the wire 22 through the drainage system. The material being dewatered is deposited and removed in a conventional manner as well.

The drainage table includes a plurality of drainage devices 30 arranged sequentially and side by side in the direction of travel from the upstream end of the drainage table to the downstream end. There are three such drainage devices 30 shown in the depicted embodiment, however, the number and configuration is a matter of choice.

Each drainage device 30 has its longitudinal dimension extending transverse with respect to the direction of travel of the web and extends the width of the web. Each drainage device 30 is depicted in the form of a foil blade which is mounted and replaced on the drainage table support in a conventional manner such as by sliding in a direction transverse to the longitudinal direction of travel of the foil. For mounting purposes, a dove tail projection 32 extends from the bottom surface 34 of each foil blade to mate with an appropriate recess in the support surface of the table. The blade includes an upstream or forward beveled edge 36 terminating in an upper point 38 formed with an upstream horizontal upper wear surface portion 40. Intermediate the upstream and downstream ends of the blade is a shoulder 42 which forms the end wall for a downstream extending recess 44. Thus, the recess 44 is bounded by the vertical shoulder 42 and intersecting horizontal depressed surface 46 on the upper side of the blade 30. Recess 44 extends downstream for the remainder of each blade 30 and terminates in an upper downstream opening 48 on the blade. This opening 48 communicates with the slot 50 between each successive pair of blades 30. For the width of foil 22, suction is applied in a conventional manner to all the slots 50 and recesses 44 of the blades 30 so that air is drawn through the foil and wet material contained thereon to collect water. This air/water mixture can then travel from recess 44 and slot 50 to separation and collection locations under the influence of suction.

The transverse edge 52 on each side of the blade is open to atmosphere and thus a transverse end zone opening 54 is located at each side of each blade 30 through which outside air can pass into recess 44 and slots 50. This would normally result in loss of suction applied in the system due to the leakage in the end zones and also reduces the efficiency of the system since the air passing through openings 54 into recess 44 does not pass through the wire and web of material thereon and does not act in dewatering the material.

Figure 2:
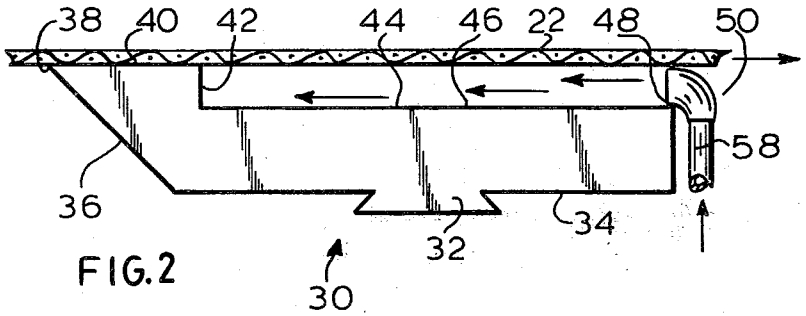
FIG. 2 is an enlarged fragmentary side view thereof with arrows showing the direction of flow of the liquid of the deckle and the direction of travel of the material being dewatered.

To avoid this leakage, a water deckle is formed at the location of each opening 54 to seal the transverse edges and accordingly the end zones of each blade 30. This is accomplished by directing a manifold conduit 56 from a conventional water source (not shown) in a direction parallel to the direction of travel of the wire 22 along the drainage table. At the location of each blade 30, a pair of transverse conduits 58 and 60 are directed from the manifold conduit 56 to each of the transverse edges of the blade. Each of the transverse conduits terminates in an opening 61 directed at the downstream open end 48 to each recess 44 of blade 30. Water directed through manifold conduit 56 and transverse conduits 58 and 60 to each blade 30, preferably under high pressure, will then flow in the direction of the arrows as shown in FIGS. 1 and 2 in an upstream direction at the transverse edge of the blade and form a water seal at the transverse edges closing openings 54 and preventing leakage of air at those points.

Thus, in operation, material to be dewatered is placed on wire 22 and directed over the surface of the drainage table 24 in the direction shown in the drawings from left to right. As it passes from the upstream to the downstream end of the drainage system and suction is applied in the drainage system to the upper surface thereof, the wet web of material passes over each blade 30 and it will be dewatered by the wear surface 40 of the upstream portion of each blade and under the influence of suction in the area of each recess 44 of each blade 30. The resulting water/air mixture will be collected in the recess 44. It is then directed from recess 44 to other interior portions of the drainage table for separation, collection and disposal.

Substantially all of the air drawn by the suction within the drainage table will pass through the surface of foil 22 and thus act in dewatering of the system without any material loss of vacuum. The end zones of each blade 30 are sealed by means of the water applied through each opening 62 of conduits 58 and 60 directed in an upstream direction and injected under high pressure from a high pressure source. In this manner, the water at the end zones or transverse edges of each blade 30 will seal opening 54 and prevent air from leaking into the drainage system at those points. The water travels upstream and counter to the direction of flow of the wet material on the wire 22 as it passes from upstream to downstream and from the wet end to the dry end of the dewatering equipment.

The water forming the end deckles can be introduced in a variety of different ways as long as it is introduced on a continuous basis to seal the ends and close openings 54. All of the air should be directed through the wire 22 thereby increasing the efficiency of the operation of the dewatering system.

Figure 3:
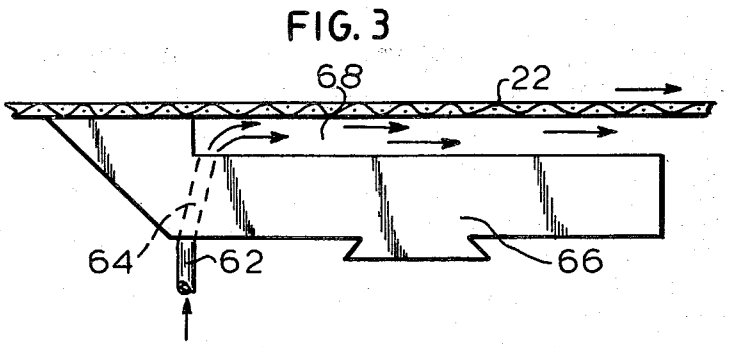
FIG. 3 is an enlarged fragmentary side view of an alternative liquid deckle of the invention with arrows showing the direction of flow of the liquid of the deckle and the direction of travel of the material being dewatered.
Figure 4:
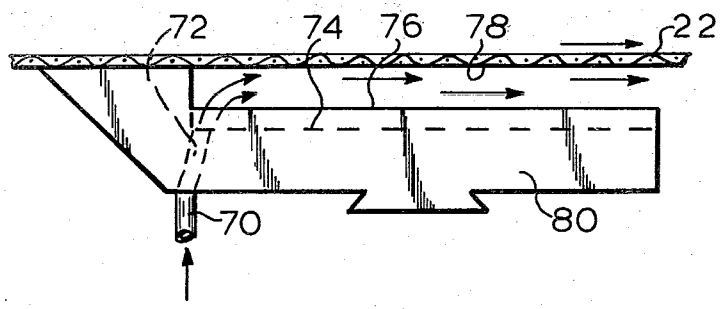
FIG. 4 is an enlarged fragmentary side view of a second alternative liquid deckle of the invention with arrows showing the direction of flow of the liquid of the deckle and the direction of travel of the material being dewatered.

Two alternative methods of introducing the water to form the end deckles are depicted in FIGS. 3 and 4. In FIG. 3, the transverse conduit 62 similar to conduits 58 and 60 of the previously discussed embodiment is connected to a slot 64 extending from the bottom end of blade 66 until it opens into the upstream end of recess 68 in the blade, corresponding to recess 44 in the blade of FIG. 2. In this arrangement, as shown by the arrows in FIG. 3, water introduced through conduit 62 and an appropriate conduit for the other transverse edge of the blade 66 would pass through the end zone of recess 68 and seal the opening to that recess thus preventing leakage of air in a similar manner as the water deckle of the embodiment of FIGS. 1 and 2. In contrast to the previously discussed embodiment, the water flowing to form the water deckle travels in a downstream direction and in the same direction as the foil 22. A low pressure injection is sufficient to introduce water flowing in the downstream direction to form the deckle and seal the end zones.

FIG. 4 shows a further alternative in which the transverse introducing conduit 70 similar to conduits 58, 60 and 62 is connected to a substantially vertical opening 72 which communicates with a groove 74 formed in the base 76 of recess 78 on the upper surface of blade 80. With the exception of opening 72 and grooves 74, blade 80 is identical to the previously discussed blades. Water introduced through conduit 70 will pass through opening 72 and travel along longitudinal groove 74 thus forming a water deckle traveling in the direction of travel of the wire, that is from the upstream end to the downstream end of the drainage system. Once again, both open transverse edges of the blade 80 can be sealed in this manner thus preventing leakage of air through the end zones formed between the upper surface of each blade 80 and the undersurface of the wire 22.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. In a deliquefying system including at least one drainage device having a wear surface and connected to a source of suction open to the wear surface and means for passing a wet web of material to be deliquefied over the wear surface so that liquid is removed from the web by the drainage device, the improvement comprising; a liquid deckle including means for injecting liquid under relatively high pressure into a substantial space at each end of the drainage device in position to prevent air from entering the drainage device through the end zone and thereby restricting the flow of air to passage through the wet web into the drainage device.

2. The invention in accordance with claim 1 wherein the deliquefying system includes papermaking machinery to dewater the wet web of material, a Fourdrinier wire supporting the wet web of material as it passes over the drainage device, and the wear surface being a bladed surface.

3. The invention in accordance with claim 2 wherein the liquid deckle is located at both transverse edges of the drainage device and includes means for injecting water into the space between the Fourdrinier wire and the drainage device thereby substantially restricting the passage of air into the drainage box to air drawn by the suction source through the Fourdrinier wire and wet web of material thereover and substantially eliminating leakage of air into the drainage box through the end zone formed at each transverse edge.

4. The invention in accordance with claim 2 wherein each bladed surface is formed with a leading beveled edge extending in a horizontal surface in the direction of travel of the wet web of material and terminating in a recess open to the source of suction through which suction is applied to remove water collected from the wet web of material passing thereover.

5. The invention in accordance with claim 2 wherein the liquid deckle is formed by injecting water under high pressure at each exposed transverse edge of the bladed surface from the downstream end of the blade in the upstream direction.

6. The invention in accordance with claim 2 wherein the liquid deckle is formed at each exposed transverse edge of the drainage device by injecting water at low pressure along each exposed transverse edge of the drainage device from the upstream end of the blade in a downstream direction with respect to the direction of travel of the wet web of material.

7. The invention in accordance with claim 2 wherein the liquid deckle is produced by injecting water through a transverse groove in the wear surface of the drainage device at the upstream end of the groove and following the groove to the downstream end in a direction substantially parallel to the direction of travel of the wet web of material.

8. The invention in accordance with claim 2 wherein the bladed surface of the drainage device includes a beveled tip at the upstream end extending in the downstream direction in the form of a horizontal wear surface engaged by the Fourdrinier wire followed by a recess downstream of the engaging wear surface to form a space between the Fourdrinier wire and the drainage device, the liquid deckle being formed by injecting liquid into the recess between the wire and the adjacent surface of the drainage device continuously and in a direction parallel with respect to the direction of travel of the wire with respect to the drainage device at each exposed transverse edge of the drainage device.

9. The invention in accordance with claim 2 wherein there are a plurality of drainage devices with bladed surfaces thereon arranged consecutively in the direction of travel of the wire and having their longitudinal dimension transverse to the direction of flow of the wire, and a liquid source provided to introduce liquid to each exposed transverse edge of each drainage device to form a liquid deckle thereon.

10. A method for preventing air from entering the end zones of a drainage device used in a deliquefying system comprising; providing at least one drainage device having a wear surface, connecting the drainage device to a source of suction open to the wear surface, passing a wet web of material to be deliquefied over the wear surface so that liquid is removed from the web by the drainage device, and forming a liquid deckle by injecting liquid under relatively high pressure into a substantial space at each end of the drainage device in position to prevent air from entering the drainage device through the end zone and thereby restricting the flow of air to passage through the wet web into the drainage device.

11. The invention in accordance with claim 10 wherein the deliquefying system includes papermaking machinery to dewater the wet web of material, a Fourdrinier wire supporting the wet web of material as it passes over the drainage device, and the wear surface being a bladed surface.

12. The invention in accordance with claim 11 wherein the liquid deckle is located at both transverse edges of the drainage device and is formed by injecting water into the space between the Fourdrinier wire and the drainage device thereby substantially restricting the passage of air into the drainage box to air drawn by the suction source through the Fourdrinier wire and wet web of material and substantially eliminating leakage of air into the drainage box through the end zones formed at each transverse edge.

13. The invention in accordance with claim 11 wherein each blade surface is formed with a leading beveled edge extending in a horizontal surface in the direction of travel of the wet web of material and terminating in a recess open to the source of suction through which suction is applied to remove water collected from the wet web of material passing thereover.

14. The invention in accordance with claim 11 wherein the liquid deckle is formed by injecting water under high pressure at each exposed transverse edge of the bladed surface from the downstream end of the blade in the upstream direction.

15. The invention in accordance with claim 11 wherein the liquid deckle is formed at each exposed transverse edge of the drainage device by injecting water at low pressure along each exposed transverse edge of the drainage device from the upstream end of the blade in a downstream direction with respect to the direction of travel of the wet web of material.

16. The invention in accordance with claim 11 wherein the liquid deckle is produced by injecting water through a transverse groove in the wear surface of the drainage device at the upstream end of the groove and following the groove to the downstream end in a direction substantially parallel to the direction of travel of the wet web of material.

17. The invention in accordance with claim 11 wherein the bladed surface of the drainage device includes a beveled tip at the upstream end extending in the downstream direction in the form of a horizontal wear surface engaged by the Fourdrinier wire followed by a recess downstream of the engaging wear surface to form a space between the Fourdrinier wire and the drainage device, the liquid deckle being formed by injecting liquid into the recess between the wire and the adjacent surface of the drainage device continuously and in a direction parallel with respect to a direction of travel of the wire with respect to the drainage device at each exposed transverse edge of the drainage device.

18. The invention in accordance with claim 11 wherein there are a plurality of drainage devices with bladed surfaces thereon arranged consecutively in the direction of travel of the wire and having their longitudinal dimension transverse to the direction of flow of the wire, and a liquid source provided to introduce liquid to each exposed transverse edge of each drainage device to form a liquid deckle thereon.

* * * * *